US008578525B1

(12) United States Patent
Seth

(10) Patent No.: US 8,578,525 B1
(45) **Date of Patent: *Nov. 12, 2013**

(54) SLEEPING BAG WITH MULTIPLE OPENINGS FOR CONCURRENT INGRESS/EGRESS OF SELECTED PARTS OF THE BODY

(76) Inventor: Sandeep Seth, Bellaire, TX (US)

( * ) Notice: Subject to any disclaimer, the term of this patent is extended or adjusted under 35 U.S.C. 154(b) by 469 days.

This patent is subject to a terminal disclaimer.

(21) Appl. No.: 12/833,998

(22) Filed: Jul. 11, 2010

Related U.S. Application Data

(63) Continuation of application No. 12/326,821, filed on Dec. 2, 2008, now Pat. No. 7,752,690, and a continuation-in-part of application No. 11/533,458, filed on Sep. 20, 2006, now abandoned, and a continuation-in-part of application No. 11/162,750, filed on Sep. 21, 2005, now abandoned.

(51) Int. Cl.
*A41B 13/06* (2006.01)
*A47G 9/02* (2006.01)
*A47G 9/08* (2006.01)

(52) U.S. Cl.
USPC ..... 5/413 R

(58) Field of Classification Search
USPC ..... 5/413 R, 502, 482; 2/69.5, 114, 111
See application file for complete search history.

(56) References Cited

U.S. PATENT DOCUMENTS

| | | | | |
|---|---|---|---|---|
| 2,504,761 | A | 4/1950 | Turco | |
| 2,530,464 | A * | 11/1950 | Haman | 2/69.5 |
| 2,888,009 | A | 5/1959 | Taylor | |
| 3,381,306 | A * | 5/1968 | Innes | 2/69 |
| 4,215,435 | A | 8/1980 | Miele | |
| 4,507,805 | A * | 4/1985 | Calutoiu | 2/69.5 |
| 4,759,083 | A | 7/1988 | Belcher | |
| 5,611,082 | A | 3/1997 | Bull | |
| 5,881,405 | A | 3/1999 | Garrigues | |
| 6,449,787 | B1 * | 9/2002 | Thorne | 5/413 R |
| 6,560,797 | B2 | 5/2003 | Maturaporn | |
| 6,983,498 | B2 | 1/2006 | Peterson et al. | |
| 2005/0051203 | A1 | 3/2005 | McCully et al. | |
| 2006/0021140 | A1 | 2/2006 | Cha | |

FOREIGN PATENT DOCUMENTS

| | | | |
|---|---|---|---|
| GB | 2183149 | A | 6/1987 |

* cited by examiner

*Primary Examiner* — William Kelleher
*Assistant Examiner* — Richard G Davis
(74) *Attorney, Agent, or Firm* — Kenneth A. Roddy

(57) ABSTRACT

A sleeping bag sized to enclose the body of a user from at least the neck to the toes has a plurality of transverse ingress/egress openings in the top cover disposed between the head end and foot end in parallel longitudinally spaced apart relation at locations corresponding generally to various body areas and segments of a human body that enable concurrent passage of selected parts or segments of the user's body into and out of the interior space such that at least one selected part or segment of the user's body can be extended into the interior space to be covered, while concurrently therewith, other selected parts or segments of the user's body can be left out or extended out of the interior space through other respective openings to be uncovered. The openings may be provided with closures and portions of the closures may be luminescent.

15 Claims, 5 Drawing Sheets

SLEEPING BAG WITH MULTIPLE OPENINGS FOR CONCURRENT INGRESS/EGRESS OF SELECTED PARTS OF THE BODY

CROSS REFERENCE TO RELATED APPLICATIONS

The present application is a Continuation of and claims priority of U.S. patent application Ser. No. 12/326,821, filed on Dec. 2, 2008, now pending, which is a Continuation-in-Part and claims priority of U.S. patent application Ser. No. 11/533,458 filed on Sep. 20, 2006, and U.S. patent application Ser. No. 11/162,750 filed on Sep. 21, 2005, both now abandoned, and the contents of these applications are incorporated herein by reference in their entirety.

BACKGROUND OF THE INVENTION

1. Field of the Invention

This invention relates generally to sleeping bags, and more particularly to a sleeping bag having a plurality of openings in the top cover that provide concurrent ingress/egress of selected parts of the user's body for selective coverage and exposure.

2. Background Art

Sleeping bags are used in a wide variety of wilderness applications, including rock and ice climbing, camping, backpacking, fishing, mountain climbing, etc. These activities are carried on throughout the year in a range of climatic regions and weather conditions.

Conventional rectangular sleeping bags are configured into a shell having a bottom portion or panel upon which a user occupying the sleeping bag lays and a top portion or panel that extends over the user to cover the user. The top and bottom portions or panels of the shell may be formed by a single panel which is folded over itself and fastened together along the foot end and one side, such as by a zipper, or the top and bottom portions or panels may be individual panels fastened together with a peripheral zipper running along the foot end and both sides. When the top and bottom portions or panels of the sleeping bag are configured into a shell, their unfastened edges define an end opening at the head end that permit the user to extend his body into the interior space; or the user may enter the interior space by unzipping one side. Typically, the user is enclosed within the interior space with only his head extending out of the opening at the head end of the sleeping bag.

Conventional mummy type sleeping bags, which generally minimize internal volume, have a laterally tapered shell shaped approximately to the contour of the body with an enclosed head end that covers the user's head. Typically, a face opening is provided at the head end that exposes the user's face, and a zipper that extends longitudinally along the center of the sleeping bag from the face opening to the foot end of the bag.

The conventional sleeping bags are primarily constructed to enclose the user's entire body, with the exception of the head or face, and rely on the conservation of heat by decreasing air movement within the bag for thermal efficiency. Thus, most sleeping bags are well suited for use in outdoor, cold ambient temperatures, however, outdoor enthusiasts who wish to use a sleeping bag in both warm and cold environments presently are required to purchase a separate sleeping bag designed for each environment. Purchasing multiple sleeping bags is costly to the user and takes up storage space in the user's home.

Another problem with conventional rectangular and mummy style sleeping bags is their relatively small lateral dimension and snug fit significantly limits the user's range of motion which makes some users feel uncomfortable and confined. The feeling of discomfort is typically heightened if parts of the user's body that are often moved, especially during sleep, such as the shoulders, chest, arms, legs, knees, and feet, are confined.

Because they are primarily constructed to retain heat by preventing warm air from escaping, most conventional sleeping bags do not provide openings in the bag structure with the exception of the head or face openings. However, each person is different and conditions of both the individual and the environment differ at any given time. For example, some people tend to sleep cold, and others tend to sleep hot, and a user may feel warmer one night than another night.

Thus, due to the construction of the conventional sleeping bags, even sleeping bags particularly designed for warm or cold environments, there is no provision for allowing a user to selectively place various different parts of his or her body desired to be kept warm into the sleeping bag so as to be covered, while at the same time, extend other parts of their body desired to be cooled out of the sleeping bag, to provide individual selective temperature control and comfort to fit the user and environmental weather conditions.

There are several patents directed toward various sleeping bags, covers, and articles of clothing having an opening through which the user's head or feet head passes.

Peterson et al, U.S. Pat. No. 6,693,498), discloses a conventional sleeping bag which includes a top, a bottom, left and right edges extending along the sides, a head end, a foot end, and a zipper extending along the foot end the right edge.

Taylor, U.S. Pat. No. 2,888,009, discloses a generally rectangular infant's sleeping bag closed along all four sides for covering an infant from the neck down, that has a circular neck opening near one end through which the infant's head passes, a zipper fastener that extends longitudinally along the center of the sleeping bag from the neck opening toward the bottom end of the bag, and ties at the four corners of the bag for attaching the sleeping bag to portions of the crib, bed, or the like upon which it is placed.

Innes, U.S. Pat. No. 3,381,306, discloses a multipurpose blanket having a single zippered head opening and zippers along the laterally opposed sides, through which a user's head passes. The single head opening is disposed in the center of the blanket in an unfolded condition and at the top end (folded end) when the blanket is folded or supported on the user's shoulders. The folded blanket may be supported on the user's shoulders and worn like a serape, or may be worn as a dressing tent wherein the lateral sides are zipped closed, and when worn like a poncho, a portion of the back side of the folded blanket is supported on top of the user's head and the neck opening forms an oval shaped opening to be used as a face opening.

Garrigues, U.S. Pat. No. 5,881,405, discloses is a personal shelter in the form of a "bivy" sack or sleeping bag that has a first foot opening at the foot end and a second opening located near the head end. The user enters and exits the "bivy" sack through the head opening and thereafter it is used for ventilation and viewing. The foot opening is a foot vent defined by edges of a top piece and an end piece that allows stagnant air within the foot end of the bivy sack to escape and fresher outside air to enter. The head opening is covered by a removable mesh screen and a mesh screen is secured over the foot opening.

Maturaporn, U.S. Pat. No. 6,560,797, discloses a generally rectangular disposable blanket for covering the front of a user from the neck down that is formed of a plurality of overlapped cover sheets ultrasonically welded along all four side edges and has a positioning slit cut through the cover sheets through which the user passes his or her head so as to wear the disposable blanket on his or her neck such and maintain the position of the entire blanket on the user's body.

McCully et al, U.S. Published Application 20050051203 discloses a generally rectangular sheet for aiding survival during outdoor activities, and as a rescue apparatus in the event of an emergency, which is suitable for use as a sleeping bag, a blanket, a distress signal indicator, a stretcher, a water catcher, a hammock, a tent, a shelter or a poncho. The sheet opposed first and second surfaces, the first surface being adapted to surround a user's body when the sheet is in a folded state. When the sheet is in the folded state, the second surface is substantially bisected into upper and lower surfaces in use. The first surface is preferably brightly colored, and may also be fluorescent or luminescent and/or reflective. Additionally or alternatively, at least the upper surface of the bisected second surface is preferably brightly colored or may be fluorescent, luminescent and/or reflective.

Calutoiu, U.S. Pat. No. 4,507,805, discloses a generally rectangular convertible sleeping bag for use as a sleeping bag and an ambulatory garment that has an integral upper torso portion extending downward to the general location of the crotch, and a lower torso portion. The bag/garment has a front and back and similar to a convention sleeping bag, has outside zippers or fasteners that extend across the top and one side, respectively. A vertical convenience zipper in the crotch area in the front and a second vertical convenience zipper in the back are disposed centrally on the front and back of the structure. A pair of laterally spaced horizontal zippers are disposed on the front to provide openings through which the arms of the user can be extended. The head of the user can be extended through the unzipped top opening, and ingress and egress from the bag is possible through either the unzipped top opening or side. The front and back are also provided with vertical zipper elements spaced below the convenience zippers that can each be fastened to the zipper element on each side to create a pair of individual leg receiving portions, which are also provided with individual zippered openings at their respective lower extremities, through which the user can extend his feet to walk while the bag/garment is being worn.

Bull, U.S. Pat. No. 5,611,082, discloses two embodiments of thermally insulated outer garments for covering the head, torso, arms, and legs of the wearer or any portion thereof, and which also cover the feet of the wearer and the footwear on the feet of the wearer. In one embodiment the garment is similar to a pair of coveralls and has separate insulated leg and foot covering portions for each leg and foot with a reclosable opening on the back of the leg portions. The other embodiment is in the form of a body suit wherein the lower portion has a sleeping bag type configuration with a single insulated enclosure for both legs and both feet with a reclosable opening on the back of the lower portion that extend from the bottom of the leg and foot portion upward to the thigh portion so that the shoe and foot covering portions may be slipped off of the foot and secured onto the upper portion of the leg. The openings on the back of the leg portions allow the wearer to extend their legs outwardly through the back of the leg portions and permit the wearer to walk about while keeping the foot portion of the insulated garment out of contact with the ground and without removing any separate parts of the garment.

Miele, U.S. Pat. No. 4,215,435 discloses a pair of convertible trousers including a body portion configured to be placed on the lower half of a human torso in a conventional manner, a pair of leg portions for accommodating therein the legs of the wearer, the leg portions each comprising a plurality of flexible interchangeable tubular elements, and snap fasteners for selectively removably securing the flexible interchangeable tubular elements coextensively together. The tubular elements may be joined to the body portion in various configurations to produce a garment of a variable length which may be altered to present several different visual appearances.

Cha, U.S. Published Application 20060021140, discloses a bed covering having an opening across horizontally at about midpoint of the vertical length of the bed covering formed by a generous overlapping of an upper portion and a lower portion of the bed covering for allowing a part of a person's body (such as the feet) to exit to the outside of the bed covering. The bed covering is comprised of two generally rectangular panels of flexible material, each having a top edge, left edge, right edge, and bottom edge. The length of the rectangular upper panel is generally longer than the length of the rectangular lower panel, but could be shorter or equal to the length of the lower panel. The vertically spaced upper and lower panels are initially two separate pieces and are vertically joined by overlapping the bottom edge of the upper panel over the top edge of the lower panel and then permanently sewing the overlapped areas together only along the left and right sides to form a continuous one-piece bed covering. The overlapped panels define the horizontal opening extending between the overlapping areas, the mouth of which is formed between the inner overlapped layer and outer overlapping layer. The overlapped configuration of the opening only allows a person who is underneath the bed cover to extend one part of their body (such as the feet) outside of the bed covering.

SUMMARY OF THE INVENTION

The present invention overcomes the aforementioned problems and is distinguished over the prior art in general, and these patents in particular by a sleeping bag having an elongate shell defining an interior space sized and shaped to enclose the body of the user from at least the neck to the toes, and a plurality of transverse body segment ingress/egress openings in the top cover panel that are disposed between the head end and foot end in parallel longitudinally spaced apart relation at locations corresponding generally to various body areas and segments of a human body that enable concurrent passage through the top cover into and out of the interior space of selected parts or segments of the user's body such that at least one selected part or segment of the user's body desired to be covered can be passed through a respective ingress/egress opening into the interior space to be covered, while concurrently therewith, other selected parts or segments of the user's body desired to be uncovered can be left out of the interior space, or extended out of the interior space through other respective ingress/egress openings to overlie the top cover. The ingress/egress openings may be provided with closures and portions of the closures may be luminescent.

BRIEF DESCRIPTION OF THE DRAWINGS

For detailed understanding of the illustrative embodiments, reference should be made to the following detailed description, taken in conjunction with the accompanying drawings, in which like elements have been given like numerals.

DESCRIPTION OF THE PREFERRED EMBODIMENTS

The present invention relates to a sleeping bag having a shell with a bottom panel portion and a top cover panel or panel portion that define an interior space that accommodates a user from at least the neck to the toes, and a plurality of transverse openings in the top cover portion disposed in longitudinally spaced apart relation between the head end and foot end of the shell at locations that enable concurrent passage through the top cover panel portion into and out of the interior space of selected parts of the user's body to provide selective coverage and exposure of selected parts of the user's body, as described in detail hereinafter.

As used herein, the following terms have the following meanings. The terms "bottom portion", "bottom panel", and "bottom panel portion" mean the portion of the sleeping bag upon which a user occupying the sleeping bag lays. The terms "top portion", "top panel" "top cover", and "top cover panel portion" mean the portion of the sleeping bag that extends over the user to cover the user or parts of the user's body. The term "sleep cover" means a separate cover member that extends over the user to cover the user or parts of the user's body. The terms "head" and "foot" mean the end portions of the sleeping bag that are disposed adjacent to the head and foot areas of the user, respectively.

Figure 1:
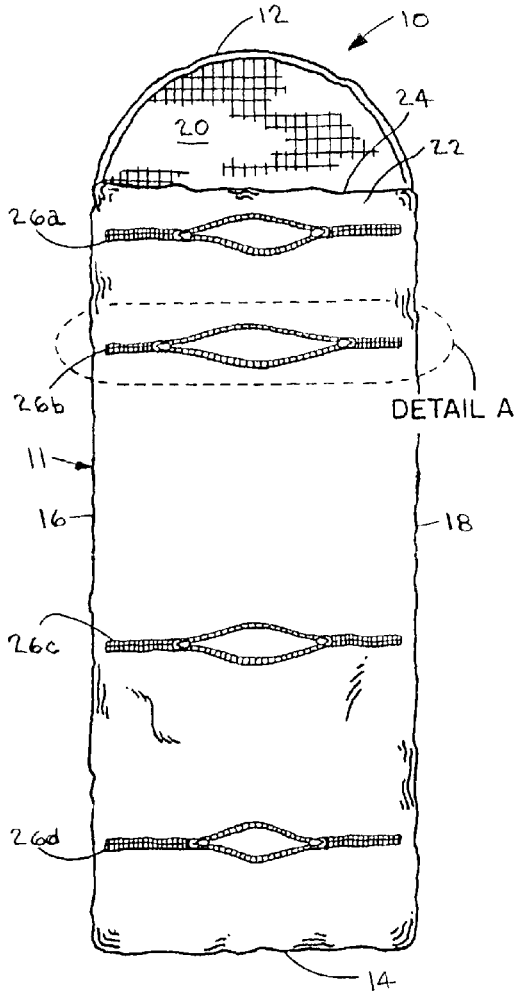
FIG. 1 is a top plan view of a first embodiment of the sleeping bag in accordance with the present invention having a generally rectangular configuration with a rounded head end.
Figure 2:
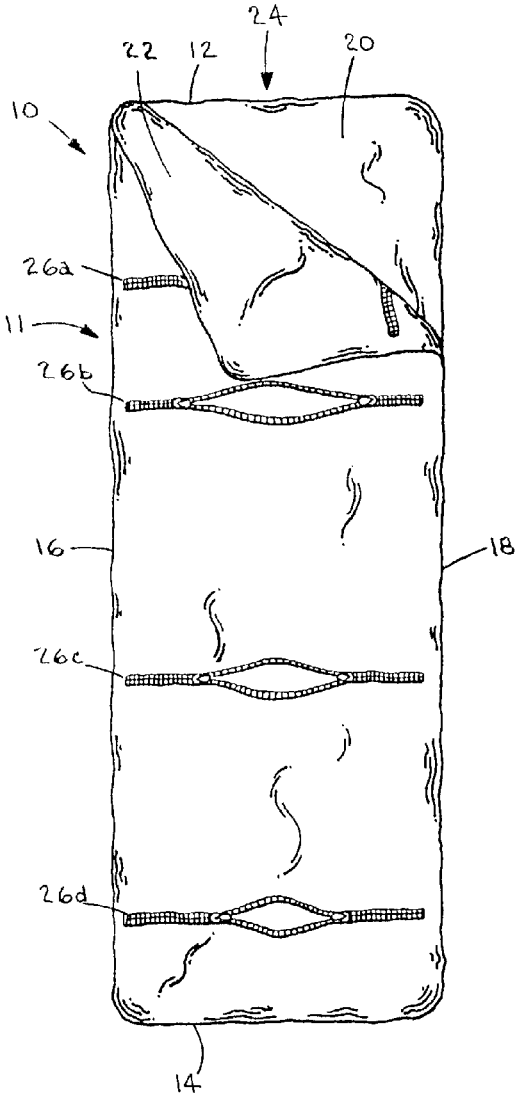
FIG. 2 is a top plan view of a second embodiment of the sleeping bag in accordance with the present invention having a generally rectangular configuration.
Figure 3:
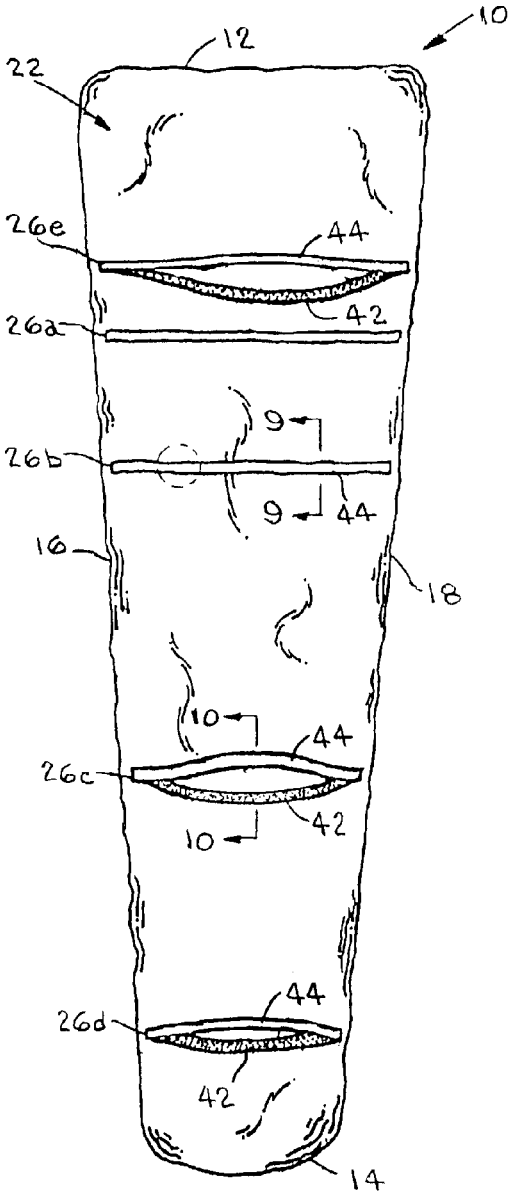
FIG. 3 is a top plan view of a third embodiment of the sleeping bag in accordance with the present invention having lateral sides that taper inwardly from the head end to the foot end.

Referring now to the drawings by numerals of reference, there is shown in FIGS. 1, 2 and 3, three examples of preferred embodiment of the sleeping bag 10 in accordance with the present invention. As in a conventional sleeping bag, the present sleeping bag 10 is made from flexible materials that are configurable to form a shell 11 having a first "head" end 12, a second "foot" end 14, a first lateral side 16, a second lateral side 18, a bottom panel 20 upon which a user occupying the sleeping bag lays, and a top cover panel 22 that extends over the user to cover the user, which define an interior space (conventional, and therefore not shown) between the top cover panel and bottom panel which is sized and shaped to receive, cover, and enclose a user's body from at least the neck to the toes. In the embodiment of FIG. 1, the sleeping bag has a generally rectangular configuration with a rounded head end 12, the embodiment of FIG. 2 has a generally rectangular configuration, and the embodiment of FIG. 3 has lateral sides 16, 18 that taper inwardly from the head end 12 to the foot end 14.

A plurality of body segment ingress/egress openings **26*a*-26*d* are formed in the top cover panel 22 and disposed between the head end 12 and the foot end 14 of the top cover panel in parallel longitudinally spaced apart relation. The openings 26*a*-26*d* extend entirely through only the top cover panel 22 and are defined by a pair of adjacent separable parallel edges disposed in opposed facing relation that extend transversely substantially across the width of the top cover panel terminating adjacent to the laterally opposed sides 16, 18 thereof. For example, more than three fourths the distance from the first side 16 to the second side 18. The location and relative spacing between the openings 26*a*-26*d* correspond generally to areas or segments and joints of the human body so as to enable selective ingress and egress of selected areas or segments of the user's body through the top cover panel 22** into and out of the interior space to provide selective coverage and exposure, and thereby control which body areas and segments are inside the interior space and which are kept on top of the bag for additional temperature control and comfort, as discussed in detail hereinafter.

The top cover panel 22 and bottom panel 20 of the shell 11 of the present invention may be formed by a single panel of flexible material which is folded over itself and fastened together along the foot end and one side, such as by a zipper (conventional, and therefore not shown), to form an opening 24 between the top cover panel and bottom panel at the head end 12; or the top cover panel 22 and bottom panel 20 may be individual panels fastened together with a peripheral zipper running along the foot end and both sides to form an opening 24 at the head end, in the manner of a conventional sleeping bag.

However, it is important to note that, unlike a conventional sleeping bag, due to the location and relative spacing of the present body segment ingress/egress openings **26*a*-26*d*, it is not necessary to have a zipper along the outer periphery of the top cover panel 20 and bottom panel 22 to permit ingress and egress of the user's body into and out of the interior space, nor is it necessary to have the conventional end opening at the head end because the user can gain access to the interior space through the openings in the top cover panel 22. The head end opening of a conventional sleeping bag is not an opening through the top cover panel of the shell, but instead is typically defined by the edges of the top cover and bottom cover at the head end of the shell and disappears when the top cover panel and bottom panel forming the shell are unzipped and unfolded (and the interior space no longer defined). In contrast, the body segment ingress/egress openings 26***a*-26*d* of the present invention are openings in and through the top cover panel 20 of the shell itself and therefore do not disappear when the bag is unfolded. With the sleeping bag of the present invention, the user may ingress and egress the interior space between the top cover panel 22 and bottom cover panel 20 even if the opening 24 at the head end 12 is closed and when the foot end 12, and sides 16, 18 are closed by the zipper.

To avoid ambiguous terms, and for a clear understanding of the location of the body segment ingress/egress openings 26*a*-26*d* of the present sleeping bag, and their functional features, as related to the human body of a user, a brief discussion of how the body is divided into regions or segments, and the terminology used to identify them is believed to be helpful.

The human body is divided into regions or "segments" that are linked by joints, or "planes of segmentation". There are eight main body segments: the head, trunk or torso, arms, forearms, hands, thighs, legs, and feet. Some visible areas of the body may also be identified by "body landmarks". The present invention concerns primarily the waist, the trunk or torso segment, the waist area, the leg segments, and feet segments, and the related planes of segmentation of the body.

The torso (trunk) segment is the central part of the upper body that extends from the neck (or neck plane) to the diaphragm (or abdominal or transtubercular plane), and includes the thorax (chest) and abdomen (the part of the body between the thorax (chest) and the pelvis. The abdominal or transtubercular plane is a transverse plane below the navel originating at the higher of the two iliac crest landmarks of the pelvis. The torso (trunk) is further segmented by a thorax plane or thoracic plane, also known as a transpyloric plane, which is just above the navel that divides the thorax from the abdomen.

The waist is the typically narrowed part of the abdomen between the lowermost ribs of the thorax (chest) and the hips, or more specifically, located generally between the thoracic or transpyloric plane and the abdominal or transtubercular plane proximate the navel. For purposes of the present invention the term "waist" refers to a transverse plane extending through the navel of a human body.

The arm segments extend from the torso (trunk) segment. The axilla (armpit) is the area on the human body directly under the shoulder joint where the arm connects to the torso (trunk). An upper portion of the thorax (chest) area of the torso (trunk) may be identified by an "axillary plane" defined as a transverse plane extending across the chest just beneath the axillae (armpits) and above the level of the nipples.

The leg segments extend between the pelvis and the ankle (or ankle plane) and are further segmented by the knee joints (or knee plane) into the upper leg or thigh segment which extends between the pelvis and the knee joint and the lower leg or cnemis segment which extends between the knee joint and the ankle joint. The foot segment extends from the ankle joint (or ankle plane).

The location of the body segment ingress/egress openings 26*a*-26*d* of the present sleeping bag correspond generally to certain body areas, body segments, and planes of segmentation discussed above. Therefore, the following terms are used to more precisely identify the body segment ingress/egress openings 26*a*-26*d* in conjunction with the present invention and with reference to the drawings.

The terms "torso", "trunk", and "chest" refer to the segment of the upper body that extends between the neck plane and the abdominal plane (waist). The term "chest opening" means a transverse opening disposed in a plane proximate the transverse "axillary plane" extending across the chest just beneath the axillae (armpits) of the human body, and is identified by the numeral 26*a*. The term "waist opening" means a transverse opening disposed in a plane proximate a transverse plane extending through the navel of the human body, and is identified by the numeral 26*b*. The term "knee opening" means a transverse opening disposed in a plane proximate the knee plane or knee joint of both knees of the human body, and is identified by the numeral 26*c*. The term "ankle opening" (foot opening?) means a transverse opening disposed in a plane proximate the ankle plane or ankle joint of both ankles of the human body, and is identified by numeral 26*d*. As used herein, the terms "foot segment" or "feet segment" refer to the segment of the foot or feet of a human body beneath the ankle plane. The term "neck opening" means a transverse opening disposed in a plane proximate the neck plane of the human body. The "head segment" means the head from the top of the head to the neck. The "leg segment" means one or both legs, from substantially the waist down to substantially the ankle joint and includes the hip and upper leg or thigh segment which extends between the pelvis and the knee joint and the lower leg or cnemis segment which extends between the knee joint and the ankle joint.

As used herein, the term "ingress/egress opening" means an opening which permits a user to extend an entire body area or joint, or segments of the body above or below the body area or joint into or out of the interior space. For example, if the ingress/egress opening is located at the waist area, then the use can extend the remaining portions of the lower body, i.e. the legs, knee and ankle joints, and feet, entirely into the interior area or entirely out of the interior area, and vise versa, as described hereinafter.

For a clear understanding of the relative spacing of the body segment ingress/egress openings 26*a*-26*d* of the present sleeping bag with respect to one another and to the human body areas and body segments, a brief definition and discussion of the known standard anthropometric data measurements of the "planes of segmentation" and "body landmarks" of the human body, is presented.

The following dimensions are based on: NASA Report Number: NASA-STD-3000, VOL 1, Man-Systems Integration Standards, Rev.B, Section 3, titled *Anthropometry and Biomechanics*, published July, 1995, National Aeronautics and Space Administration (NASA-JSC) (http://msis.jsc.nasa.gov/Volume1.htm); NASA Report Number: NASA-RP-1024, S-479-VOL-1, Titled *Anthropometry For Designers*, published Jul. 1, 1978 by NASA Technical Reports Server (NTRS) (http://ntrs.nasa.gov/search.jsp); Technical Report No: NATICK/TR-96/036 titled 1995 *Matched Anthropometric Database Of U.S. Marine Corps Personnel: Summary Of Statistics*, published September 1996 by the United States Army Soldier Systems Command Natick Research, Development and Engineering Center, Natick, Mass. 01760. http://www.humanics-es.com/ADA316646.pdf; and Department of Defense Handbook DOD-HDBK-743A *Military Handbook Anthropometry Of U.S. Military Personnel*, published Feb. 13, 1991, Department of Defense (http://assist.daps.dla.mil/quicksearch/basic_profile.cfm?ident_number=54083).

The dimensions discussed below were compiled from the mean dimensions or the 50th percentile dimensions given in the above publications of an adult male, and have been rounded off for ease of understanding and purposes of discussion.

Based on anthropometric data measurements of an average size adult male 5'-9¼" in height (69.25"), the following are average height measurements: The height from the bottom of the foot to the center on the kneecap (knee plane) is approximately 19⅞" (19.84"); the ankle height from the bottom of the foot to the center of the ankle bone (ankle plane) is approximately 5½" (5.5"). Thus, the distance between the knee plane and the ankle plane is approx 14⅜" (14.34"). The height from the bottom of the foot to the center of the navel (omphalion waist height) is approx 41¾" (41.73"). Thus, the distance between the knee plane and the center of the navel (omphalion waist height) is approx 21⅞" (21.89"). The chest height or axilla (armpit) height from the bottom of the foot to the armpits (axillary plane) is approx 52" (51.96"). Thus, the distance between the navel (omphalion waist height) and the axillary plane (or armpit) is approx 10¼" (10.23").

Using the dimensional data discussed above, in a non-limiting example of a sleeping bag that would accommodate an adult male of average height, the chest opening 26*a* and the waist opening 26*b* would be spaced about 10¼" apart, the waist opening 26*b* and the knee opening 26*c* would be spaced about 21⅞" apart, and the knee opening 26*c* and the ankle opening (foot opening) 26*d* would be spaced about 14⅜" apart.

It should be understood that the dimensions discussed above are presented for purposes of example only, and are not limited thereto. The present sleeping bag and spacing of the openings 26*a*-26*d* may be varied to accommodate a wide range of adult males and females, male and female youths, and children.

Therefore, as used herein in conjunction with the present invention, and related to a user, the relative spacing between openings 26*a*-26*d* that are disposed between the head end 12 and the foot end 14 may be described in the following manner. The relative spacing between openings 26*a*-26*d* is such that chest opening 26*a* is disposed proximate the "axillary plane" of the user's chest beneath the axillae (armpits); the waist opening 26*b* is disposed approximate the navel of the user; the knee opening 26*c* is disposed proximate the knees of the user; and the ankle opening (foot opening) 26*d* is disposed proximate the ankles of the user.

The embodiment of the sleeping bag 10 of FIG. 3 shows a modification wherein the top cover panel 22 is provided with an additional "neck opening" 26*e* which is disposed between the head end 12 and the chest opening 26*a* in a transverse plane proximate the neck plane of the human body adjacent to the two clavicle landmarks (collarbones).

It should be understood from the foregoing that the location and spacing of the body segment ingress/egress openings 26*a*-26*d* enable selective ingress and egress of selected areas or segments of the user's body through the top cover panel 22 into and out of the interior space of the sleeping bag and enable the user to place at least one selected part or segment desired to be covered through a respective opening into the interior space to be covered, while concurrently therewith, other selected areas or segments of the user's body desired to be uncovered can be left out of the interior space, or extended out of the interior through other respective openings to overlie the top cover to provide selective coverage and exposure.

Referring now FIGS. 4, 5, 6 and 7, the user is shown with various parts or body segments placed into and out of the interior space of the sleeping bag 10 through the body segment ingress/egress openings in the top cover panel 22, in accordance with the present invention.

The user simply selects which body areas or segments he wishes to have covered and uses the corresponding ingress/egress opening to pass through the body areas or segments that he wants covered into the interior space and the body areas and segments that he wants to have uncovered out of the interior space. For example, if the user wants to be covered from his neck or chest down to his ankles but have his feet uncovered, then he simply opens the body segment ingress/egress opening corresponding to his neck or chest and feet, slides his body into the interior space through the neck or chest opening, and has his feet exit the interior space through the ankle opening. The user can also cover just his feet, just his feet and legs, just his feet, legs and chest, his entire body all the way up to his neck, or everything but his feet. Moreover, any region of the top cover panel 22 that is not being used to cover a body segment may be used in conjunction with the bottom panel 20 for added padding underneath the user's body.

Figure 4:
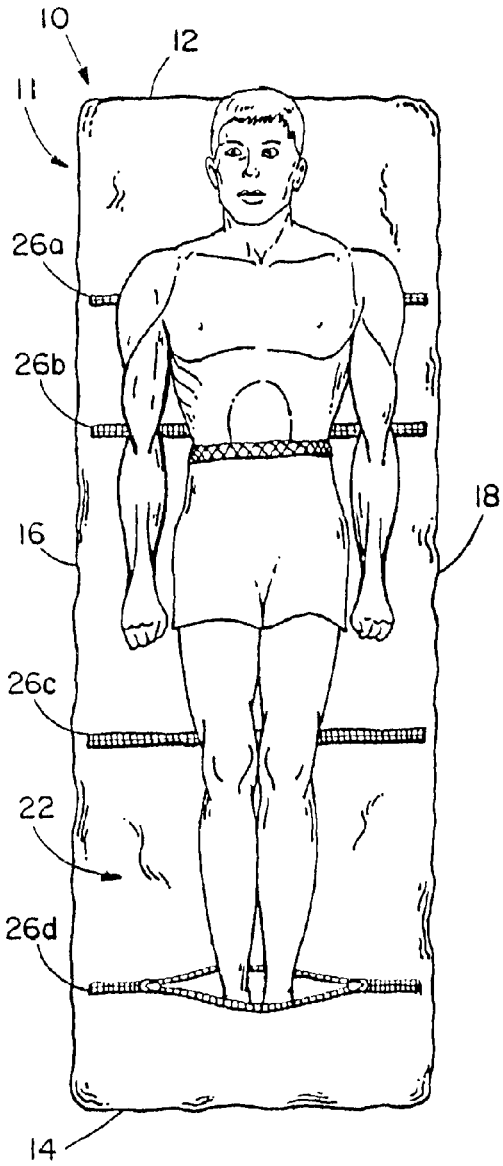
FIG. 4 is a top plan view showing a user lying on top of the sleeping bag of FIG. 2, with his feet from the ankles down placed into the interior space through a body segment ingress/egress opening so as to cover only his feet.

In FIG. 4, for example, the user is shown lying on the top cover panel 22 and covering only the foot segment of his body by placing his feet from the ankles down into the interior space of the bag 10 through the ankle opening 26*d* in the top cover panel 22. It should be understood that only one foot may be placed into the interior space and the other foot left out of the interior space. The user also has the comfort of the extra padding from his ankles to his head that is provided by the top cover panel 22 beneath him in the region between the head end 12 and the ankle opening 26*d*.

Figure 5:
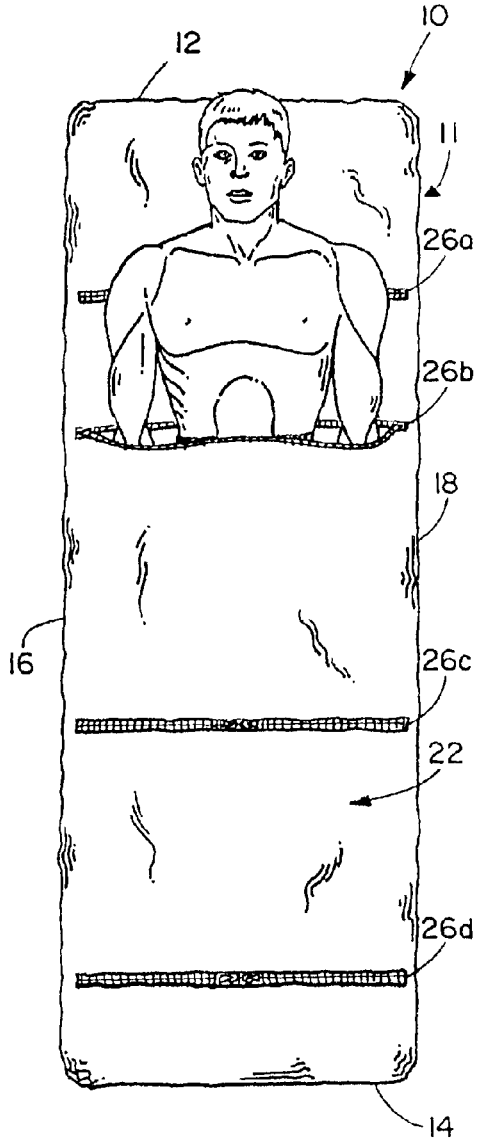
FIG. 5 is a top plan view showing a user lying on top of the sleeping bag of FIG. 2, with his upper body on top of the sleeping bag and his lower body from the waist down placed into the interior space through a second body segment ingress/egress opening so as to cover his lower body from the waist down.

Similarly, the user is shown in FIG. 5 with his upper body including the torso chest and upper arms lying on top of the top cover panel 22 and covering his lower body from the waist down including both the leg segment and foot segment of his body by placing his body from the waist down into the interior space through the waist opening 26*b*. The user also has the comfort of the extra padding from his waist to his head that is provided by the top cover panel 22 beneath him in the region between the head end 12 and the ankle opening 26*d*. It should be understood that one or both of the lower arm segments may be selectively placed into or out of the interior space.

Figure 6:
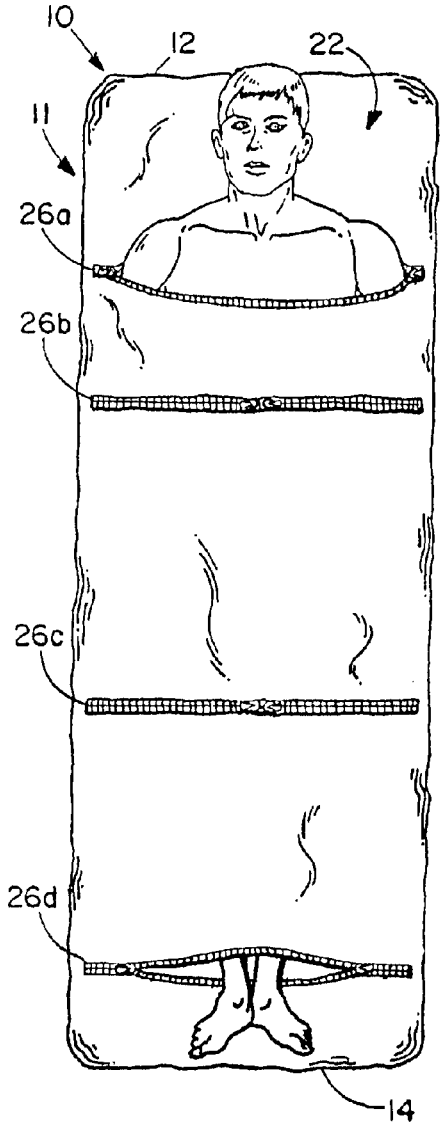
FIG. 6 is a top plan view showing a user of the sleeping bag of FIG. 2, with his shoulders, upper chest, and head, on top of the sleeping bag so as to be uncovered, his lower body from the upper chest area to the ankles placed into the interior space through a third body segment ingress/egress opening so as to be covered, and his feet extending outwardly from the interior space through a second body segment ingress/egress opening so as to be uncovered.

In FIG. 6, the user is shown with his shoulders, upper chest, and head, extended through the chest opening 26*a* to reside on top of the sleeping bag so as to be uncovered, with his lower body from the upper chest area to the ankles inside the interior space so as to be covered, and his foot segment (both feet) from the ankles down extending out of the interior space through the ankle opening 26*d* so as to be uncovered. The user also has the comfort of the extra padding from his upper chest to his head that is provided by the top cover panel 22 beneath him in the region between the head end 12 and the chest opening 26*a*, and beneath his feet in the region between the ankle opening 26*d* and the foot end 14. It should be understood that one or both of the arm segments and one or both of the foot segments may be selectively placed into or out of the interior space.

Figure 7:
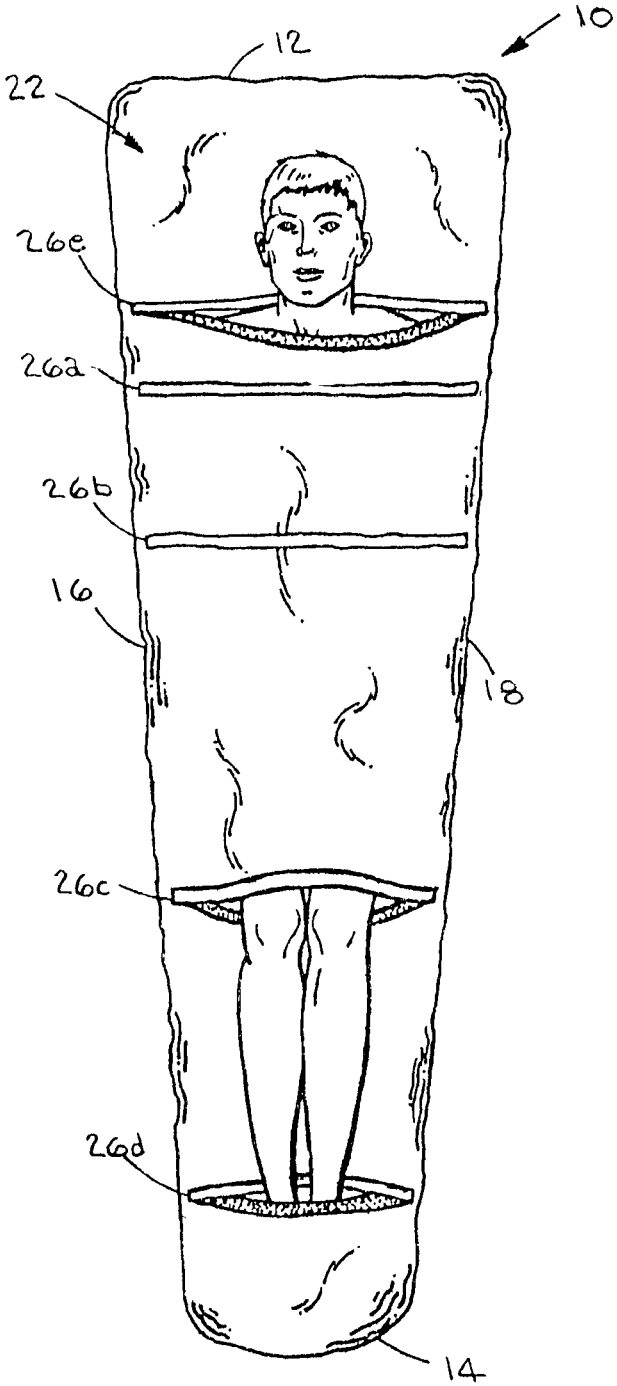
FIG. 7 is a top plan view of the tapered embodiment of the sleeping bag of FIG. 3, showing a user with his head on top of the sleeping bag so as to be uncovered, his body from the neck to the knees placed into the interior space through a third body segment ingress/egress opening so as to be covered, his legs from the knees to the ankles feet extending outwardly from the interior space through a second body segment ingress/egress opening so as to be uncovered, and his feet from the ankles down placed into the interior space through a third body segment ingress/egress opening so as to be covered.

In FIG. 7, the user is shown with his head and neck segments extended through the neck opening 26*e* to reside on top of the sleeping bag so as to be uncovered, with his lower body from the neck down inside the interior space so as to be covered, his lower leg segment from the knees to the ankles extended out of the interior space through the knee opening 26*c* so as to be uncovered and his foot segment (both feet) from the ankles down extending into the interior space through the ankle opening 26*d* so as to be uncovered. It should be understood that one or both of the lower leg segments and one or both of the foot segments may be selectively placed into or out of the interior space. It should also be understood that his lower body from the waist down including the upper and lower leg segments and foot segment may be uncovered by extending his lower body from the waist down out of the interior space through the waist opening 26*b*, with one or both of the foot segments selectively placed into or out of the interior space.

Each of the body segment ingress/egress openings 26*a*-26*d* in the top cover panel 22 may be provided with closure means 28 for selectively joining their edges together to close the opening and separating the edges to open the openings so that any body segment ingress/egress opening that is not being used to permit ingress or egress of the parts of the user's body into or out of the interior space. While any suitable closure means 28 for selectively opening and closing the openings may be used, preferably, such means is comfortable to the user, easy to use, and durable. Some examples of such closure means include selectively engageable zipper strips, hook and loop fastener strips, and opposite polarity flexible magnetic strips, or flexible soft rubber zipper strips.

Figure 8:
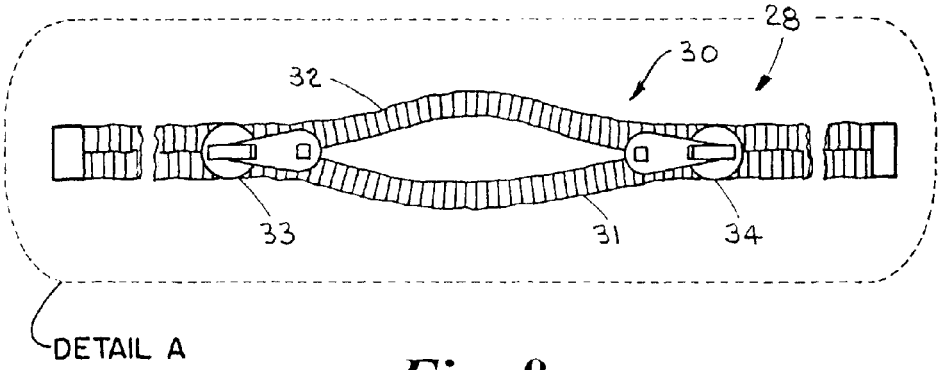
FIG. 8 is an enlarged plan view showing the zipper fastener, represented as detail A in FIG. 1, in greater detail.

In a non-limiting example, the exemplary sleeping bags of FIGS. 1 and 2, show a flexible closed end nylon or plastic coil zipper arrangement 30 (detail "A", shown in greater detail in FIG. 8), having flexible nylon or plastic toothed strips 31, 32 affixed to the opposed facing edges of the opening and closed at both ends with head to head sliders 33, 34 having soft rubber pulls, although any other suitable configurations and materials may be used. It has been discovered through experimentation that even metal zipper teeth and pulls do not significantly impact the user's thermal or tactile comfort when lying atop the sleeping bag, but that nylon, plastic or lightweight metal zipper teeth and pulls are preferable for the user's tactile and thermal comfort and also tend to diminish heat loss out from the interior area of the sleeping bag. The zipper pulls, sliders, and/or zipper teeth, or additional slider pull element such as a nylon cord attached to the slider, may be made of a luminescent "glow-in-the-dark" material to enhance the visibility of the ingress/egress openings at night. It is contemplated that other means of making the ingress/egress openings of the sleeping bag more visible at night, may be employed that do not rely upon luminescent material but rather may employ other suitable lighting elements.

Figure 9:
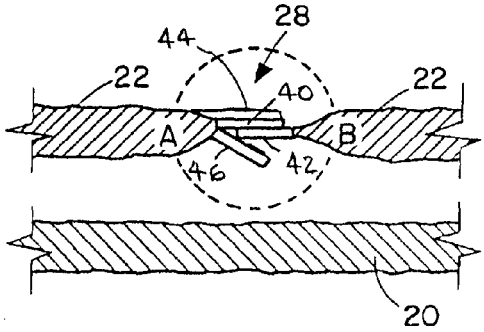
FIGS. 9 and 10 are cross sectional views taken along line 9-9 and line 10-10 of FIG. 3 showing an alternate closure means for selectively opening and closing an ingress/egress opening with the opening shown in the closed position and in the open position, respectively.
Figure 10:
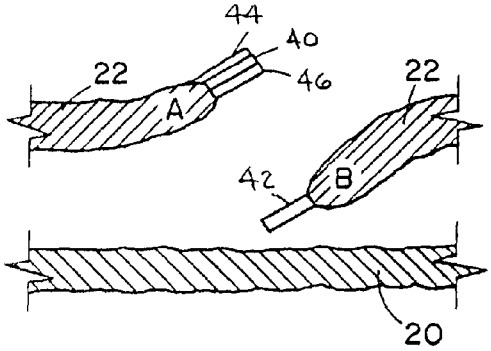
Figure 11:
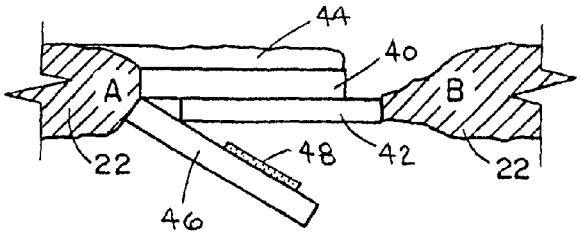
FIG. 11 is an enlargement of an encircled portion of FIG. 3 showing a cover strip pushed out of the way to permit engaging and disengaging the closure.

The sleeping bag of FIG. 3 shows an example wherein the closure means 28 are overlapping hook and loop fastener strips, shown in greater detail in FIGS. 9-11. The overlapping strips of hook and loop fasteners 40, 42 run substantially the length of the opposed facing edges of the ingress/egress opening. The hook fastener strip 40 is affixed, such as by sewing, to an extension strip 44 that is itself affixed to or integral with the top cover panel portion 22, referred to as side "A".

The extension strip 44 may be made of the same material as the top cover panel 22 or may be made of a different sufficiently durable material such as nylon. The loop fastener strip 42 is shown affixed directly to the top cover panel 22 on side "B" in a location that will permit the hook fastener strip 40 to engage the loop fastener strip 42 to seal or close the ingress/egress opening. It is understood that the loop fastener strip could also be attached in a different manner to the top cover panel side "B", such as by also being affixed to its own extension.

A cover strip 46 is affixed, such as by sewing, to side "A" of the top cover panel 22 adjacent to the extension 44. When the hook and loop fastener strips 40, 42 are engaged, as shown in FIGS. 9 and 11, the cover strip 46 is pushed out of the way.

As best seen in FIG. 11, when the hook and loop fastener strips 40, 42 are disengaged to unseal or open a body segment ingress/egress opening, the cover strip 46 covers the hook fastener strip 40 so that it does not engage the loop fastener strip 42 or the user's clothing. The cover strip 46 may be made of any suitable material that can itself grip to the hook fasteners, or further include small spaced apart swatches 48 of loop fasteners attached thereto that engage the hook fastener strip 40 so that the cover strip may securely cover the hook fastener strip. The hook and loop fastener strip material is selected so as to form a secure engagement that will not come opened during the sleep yet having a reasonable break away tension so that the user need not struggle to open the ingress/egress opening when desired.

Alternatively, the hook and loop fastener strips may be replaced with other suitable means to selectively seal and unseal the ingress/egress opening such as flexible magnetic strips of opposite polarity. The flexible magnetic strips may be affixed to the top cover panel in the same manner as the hook and loop fastener strips shown in FIG. 9-11 to selectively engage and disengage and thereby open and close an ingress/egress opening. Alternatively, the magnetic strip substituting for the loop fastener strip may be affixed to an inside surface of the top cover panel, rather than on an outer surface. Again, the magnetic strength of magnetic strips should provide secure engagement without requiring undue breakaway tension.

It should be understood that at least a portion of the hook and loop fastener strips, the extension strips, or the flexible magnetic strips may be made of a luminescent "glow-in-the-dark" material to enhance sleeping bag visibility at night.

As in a conventional sleeping bag, a sleeping bag of the present invention may be made of any suitable material such as fabric or nylon as just two examples. Moreover, the material making up any portion of the bag need not be the same as the material making up any other portion. It will be understood, for example, that the material making up the bottom panel 20 may be softer, more padded or more breathable than the material making up the top cover panel 22, and the portions of the bag include waterproof or water resistant materials.

It should be understood that a sleeping bag in accordance with the present invention can be adapted for domestic use. For example, the material forming the panels 20, 22 may be lighter, need not be breathable or waterproof, and may be made of any conventional sheet, blanket, or comforter material. In this embodiment, like a sleeping bag, a zipper may be provided to permit a closed shell to be formed when the panels 20, 22 are overlapped and zipped together. Alternatively, the zipper need not be provided and an open shell formed by simply folding a single panel over to form the top cover panel 22 and bottom panel 20.

It should also be understood that, where not required, the bottom panel 20 may be eliminated entirely and top cover panel 22 used alone as a sleep cover. In such an embodiment, no peripheral zipper or other means for attaching to the top cover panel is necessary. Thus, blankets and comforters can be outfitted with the present body segment ingress/egress openings to enable the user to select which body segments underlie and which body segments underlie the sleep cover, in the same manner as described herein with a full sleeping bag.

It should further be understood that in the practice of the present invention, the user need not actually be sleeping to enjoy the benefits of the present invention but may enjoy the body temperature control provided thereby while awake.

While the invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein.

Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention. Thus, it shall be understood that while this invention has been described with respect to various specific examples and embodiments, the invention is not limited thereto and that it can be variously practiced within the scope of the following claims.

The invention claimed is:

1. A sleeping bag for receiving and providing selective concurrent coverage and exposure of two body areas and segments of a body of a human user, comprising:

an elongate sleeping bag shell comprising a flexible top cover panel and a flexible bottom panel, each having a head end, a foot end, and laterally opposed sides defining an interior space therebetween sized and shaped to receive, cover, and enclose the body of a human user from at least a neck of the body of the user to toes of the body of the user in said interior space;

a transverse waist opening and a transverse ankle opening in said top cover panel disposed in longitudinally spaced apart locations between said head end and said foot end thereof extending transversely substantially across the width of said top cover panel terminating adjacent to said laterally opposed sides thereof, each extending entirely through only said top cover panel and defined by a pair of adjacent separable edges of said top cover panel disposed in opposed facing relation; and closure means on each of said adjacent separable edges of each of said body segment ingress/egress openings in said top cover panel for selectively joining said adjacent separable edges together to close said openings and separating said adjacent separable edges to open said openings;

said transverse waist opening disposed in a plane at a location adapted to correspond generally to a transverse plane extending through a waist area of the body of the user, which in an open condition enables ingress of a lower body segment below the waist area including upper leg segments, knee joints, ankle joints, and foot segments of the body, into said interior space so as to be capable of being covered by said top cover panel and, concurrently therewith, egress of an upper body segment above the waist area including a torso segment, arm segments, neck, and head of the body out of said interior space so as to be capable of being uncovered by said top cover panel, and vice versa, and said transverse ankle opening disposed in parallel longitudinally spaced apart relation to said waist opening in a plane at a location adapted to correspond generally to a transverse plane extending through the ankle joints of the body of the user, which in an open condition enables selective ingress of either one or both of the foot segments into said interior space so as to be capable of being covered by said top cover panel or egress of either one or both of the foot segments out of said interior space so as to be capable of being uncovered by said top cover panel.

2. The sleeping bag according to claim 1, wherein said head end of said top cover panel and said bottom panel and said foot end of said top cover panel and said bottom panel are closed.

3. The sleeping bag according to claim 1, wherein said closure means is selected from the group consisting of selectively engageable and disengageable zipper strips, hook and loop fastener strips, and opposite polarity flexible magnetic strips.

4. The sleeping bag according to claim 3, wherein at least a portion of said closure means is luminescent.

5. The sleeping bag according to claim 3, wherein said closure means comprises zipper strips with at least one slider and slider pull means for pulling said slider, at least one of which is luminescent.

6. A sleeping bag for receiving and providing selective concurrent coverage and exposure of two body areas and segments of a body of a human user, comprising:

an elongate sleeping bag shell comprising a flexible top cover panel and a flexible bottom panel, each having a head end, a foot end, and laterally opposed sides defining an interior space therebetween sized and shaped to receive, cover, and enclose the body of a human user from at least a neck of the body of the user to toes of the body of the user in said interior space;

a transverse chest opening and a transverse ankle opening in said top cover panel disposed in longitudinally spaced apart locations between said head end and said foot end thereof extending transversely substantially across the width of said top cover panel terminating adjacent to said laterally opposed sides thereof, each extending entirely through only said top cover panel and defined by a pair of adjacent separable edges of said top cover panel disposed in opposed facing relation; and closure means on each of said adjacent separable edges of each of said body segment ingress/egress openings in said top cover panel for selectively joining said adjacent separable edges together to close said openings and separating said adjacent separable edges to open said openings;

said transverse chest opening disposed in a plane at a location adapted to correspond generally to a transverse axillary plane extending across a chest area of the body of the user, which in an open condition enables ingress of the chest area below the transverse axillary plane, including a waist area, knee joints, leg segments, ankle joints, and foot segments of the body, into said interior space so as to be capable of being covered by said top cover panel and, concurrently therewith, egress of the chest area above the transverse axillary plane out of said interior space so as to be capable of being uncovered by said top cover panel; and concurrently therewith, said chest opening enabling selective ingress or egress of either one or both arm segments of the body of the user into or out of said interior space; and said transverse ankle opening disposed in parallel longitudinally spaced apart relation to said chest opening in a plane at a location adapted to correspond generally to a transverse plane extending through the ankle joints of the body of the user, which in an open condition enables selective ingress of either one or both of the foot segments into said interior space so as to be capable of being covered by said top cover panel or egress of either one or both of the foot segments out of said interior space so as to be capable of being uncovered by said top cover panel.

7. The sleeping bag according to claim 6, wherein said head end of said top cover panel and said bottom panel and said foot end of said top cover panel and said bottom panel are closed.

8. The sleeping bag according to claim 6, wherein said closure means is selected from the group consisting of selectively engageable and disengageable zipper strips, hook and loop fastener strips, and opposite polarity flexible magnetic strips.

9. The sleeping bag according to claim 8, wherein at least a portion of said closure means is luminescent.

10. The sleeping bag according to claim 8, wherein said closure means comprises zipper strips with at least one slider and slider pull means for pulling said slider, at least one of which is luminescent.

11. A sleeping bag for receiving and providing selective concurrent coverage and exposure of two body areas and segments of a body of a human user, comprising:

an elongate sleeping bag shell comprising a flexible top cover panel and a flexible bottom panel, each having a head end, a foot end, and laterally opposed sides defining an interior space therebetween sized and shaped to receive, cover, and enclose the body of a human user from at least a neck of the body of the user to toes of the body of the user in said interior space;

a transverse chest opening and a transverse knee opening in said top cover panel disposed in longitudinally spaced apart locations between said head end and said foot end thereof extending transversely substantially across the width of said top cover panel terminating adjacent to said laterally opposed sides thereof, each extending entirely through only said top cover panel and defined by a pair of adjacent separable edges of said top cover panel disposed in opposed facing relation; and closure means on each of said adjacent separable edges of each of said body segment ingress/egress openings in said top cover panel for selectively joining said adjacent separable edges together to close said openings and separating said adjacent separable edges to open said openings;

said transverse chest opening disposed in a plane at a location adapted to correspond generally to a transverse axillary plane extending across a chest area of the body of the user, which in an open condition enables ingress of the chest area below the transverse axillary plane, including a waist area, knee joints, upper and lower leg segments, ankle joints, and foot segments of the body, into said interior space so as to be capable of being covered by said top cover panel and, concurrently therewith, egress of the chest area above the transverse axillary plane out of said interior space so as to be capable of being uncovered by said top cover panel; and concurrently therewith, said chest opening enabling selective ingress or egress of either one or both arm segments of the body of the user into or out of said interior space; and said transverse knee opening disposed in a plane at a location adapted to correspond generally to a transverse plane extending through knee joints of the body of the user, which in an open condition enables ingress of one or both lower leg segments, ankle joints and foot segments of the body, into said interior space so as to be capable of being covered by said top cover panel and, concurrently therewith, egress of one or both upper leg segments, the waist area, a torso segment, and the arm segments, out of said interior space so as to be capable of being uncovered by said top cover panel, and vice versa.

12. The sleeping bag according to claim 11, wherein said head end of said top cover panel and said bottom panel and said foot end of said top cover panel and said bottom panel are closed.

13. The sleeping bag according to claim 11, wherein said closure means is selected from the group consisting of selectively engageable and disengageable zipper strips, hook and loop fastener strips, and opposite polarity flexible magnetic strips.

14. The sleeping bag according to claim 13, wherein at least a portion of said closure means is luminescent.

15. The sleeping bag according to claim 13, wherein said closure means comprises zipper strips with at least one slider and slider pull means for pulling said slider, at least one of which is luminescent.

* * * * *